United States Patent [19]

Lathrop et al.

[11] Patent Number: 5,060,901

[45] Date of Patent: Oct. 29, 1991

[54] WHOLE HOUSE FAN

[75] Inventors: David R. Lathrop, Glen Carbon, Ill.; James P. Shawcross, Chesterfield, Mo.

[73] Assignee: Emerson Electric Co., St. Louis, Mo.

[21] Appl. No.: 535,710

[22] Filed: Jun. 11, 1990

[51] Int. Cl.[5] ..... F24F 7/06

[52] U.S. Cl. ..... 248/343; 98/42.08

[58] Field of Search ..... 248/674, 544, 343; 98/42.1, 42.08, 42.09, 42.07, 42.11; 403/231.1; 52/39, 517, 512

[56] References Cited

U.S. PATENT DOCUMENTS

| | | | |
|---|---|---|---|
| 3,256,030 | 6/1966 | Banse | 52/712 X |
| 4,385,550 | 5/1983 | Steiner | 248/343 X |
| 4,406,216 | 9/1983 | Hott | 248/343 X |
| 4,501,194 | 2/1985 | Brown | 98/42.07 |
| 4,517,776 | 5/1985 | Barker | 52/712 |
| 4,594,940 | 6/1986 | Wolbrink | 98/42.1 |
| 4,766,806 | 8/1988 | Tomiser | 98/42.1 |
| 4,779,518 | 10/1988 | Artwick | 98/116 |

*Primary Examiner*—Alvin C. Chin-Shue
*Assistant Examiner*—Robert A. Olson
*Attorney, Agent, or Firm*—Polster, Polster and Lucchesi

[57] ABSTRACT

A whole house, direct drive fan is disclosed wherein the fan motor is secured directly to a single joist by means of a motor mounting bracket. A venturi housing is separately secured directly to the joist on which the fan motor is mounted.

8 Claims, 3 Drawing Sheets

WHOLE HOUSE FAN

BACKGROUND OF THE INVENTION

This invention relates to a whole house fan, and, in particular, to a direct drive whole house fan wherein the fan motor is mounted on top of a single joist.

The use of whole house fans to help keep houses cool during summer months has long been known. The advantages to using whole house fans is set out in detail in U.S. Pat. No. 4,501,194 to Brown assigned to Emerson Electric Co.

Installation of whole house fans, such that a home owner or a "do-it-yourselfer" could install them, has only recently become popular. In many prior whole house fans it was necessary to cut ceiling joists and to form a plenum box by nailing header plates between the uncut joists and the ends of the cut joists. This involves major carpentry work which, depending upon the structure of the roof, could weaken the roof.

To eliminate this problem, whole-house fans were introduced which included a frame mountable on the tops of adjacent ceiling joists over an opening in the ceiling. A venturi was carried by the frame and a skirt depended downwardly from the venturi and fit around the uncut joists to form a plenum box. The frame was mounted on the joists and the motor was mounted on crossbars of the frame beneath the venturi. The motor was thus mounted between and supported by two joists and a large frame. Importantly, these "easy-to-install" whole house fans did not require cutting of ceiling joists when the opening was made in the ceiling. The above-mentioned patent to Brown and U.S. Pat. No. 4,385,550 to Steiner et al, also co-assigned to Emerson Electric Co., are examples of such "easy-to-install" whole house fans.

In order to make the installation of whole house ceiling fans even easier and to reduce the cost of such fans, it was desirable to make the motor and fan directly mountable to a middle joist centered on the ceiling opening and to make the venturi separately mountable directly to the middle joist. However, it was feared that if the direct drive motor and fan were mounted to a single joist, the fan would be unstable and would wobble on the joist. This in turn would cause the joist to also wobble or twist and could result in damage to the joist or ceiling of the house and would result in objectionable noise.

SUMMARY OF THE INVENTION

One object of the present invention is to provide a whole house fan wherein the motor and fan can be mounted on a single joist without the motor generating objectionable noise.

Another object is to provide such a fan which may be easily installed by a homeowner.

Another object is to provide such a fan which incorporates smaller pieces than prior fans thus enabling compact shipping and insuring that the installer can readily pass the fan parts through the ceiling opening from below for ease of installation.

Another object is to provide such a fan which is sturdy, yet is inexpensive to produce, and which has a long service life.

In accordance with these objectives, generally stated, a direct drive whole house fan assembly of the present invention is provided for installation over joists in an opening in a ceiling. This whole house fan assembly includes a venturi defining an air path, a fan for forcing air through the air path, a motor for driving the fan, and a skirt depending downwardly from the venturi and accommodating the joists to form a plenum box and to define, at least in part, the above-noted air path. The opening in the ceiling exposes at least one joist spanning the opening. The motor and fan are mounted to this last-said motor joist by a motor bracket. The venturi is mounted to the joist on which the motor is mounted by means of venturi brackets separate from the motor bracket.

The motor bracket comprises a pair of identical L-shaped members which are secured to the joist and stiffening members which are attached to the tops of the L-shaped members. The fan motor is secured to the L-shaped members and elastomeric grommets are placed between the motor and the bracket to dampen vibrations.

The venturi bracket includes a U-shaped member which fits over and is secured to one side of the joist, allowing for any width joist and an upwardly extending plate to which the venturi is secured.

A method of mounting the fan is also disclosed.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
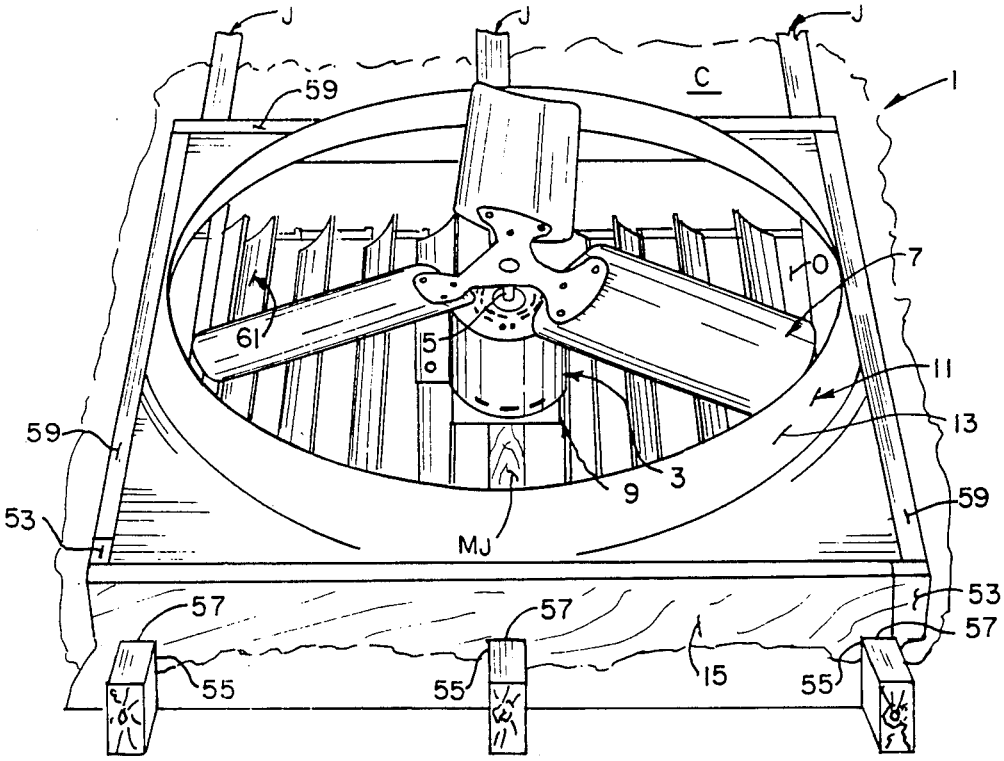
FIG. 1 is a perspective view of a whole house fan of the present invention assembled and mounted on the ceiling joists in an attic.

Referring to the drawings, reference numeral 1 generally indicates one illustrative embodiment of a whole house fan assembly of the present invention. Whole house fan 1 is mounted on a joist MJ over an opening O in a ceiling C. More specifically, whole house fan 1 includes a direct drive motor 3 having an upwardly extending motor shaft 5 on which a fan blade assembly 7 is mounted. Motor 3 is mounted on joist MJ by a motor mount bracket, as generally indicated at 9.

A venturi assembly 11 surrounds motor 3 and fan blade assembly 7. Venturi assembly 11 includes a venturi 13 and a downwardly extending skirt 15 which accommodates joists J and MJ to define an air path through ceiling opening O to venturi throat 13. Venturi assembly 11 is mounted to joist MJ by venturi brackets 17.

Figure 4:
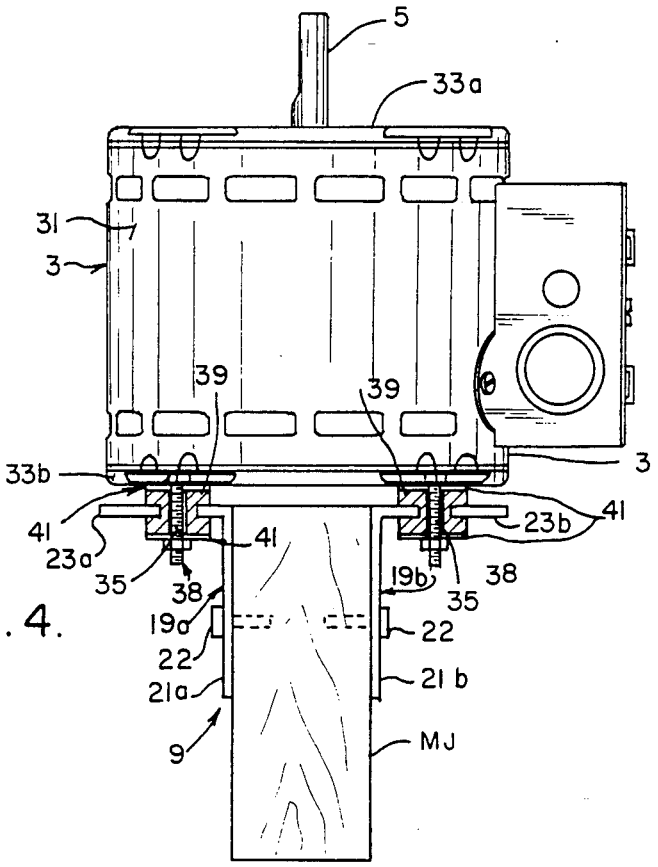
FIG. 4 is cross sectional view taken along line 4—4 of FIG. 2 showing the fan motor mounted on a motor mounting bracket secured to a joist (i.e., the motor joist) with the stiffening brackets, on the motor bracket omitted for clarity.
Figure 7:
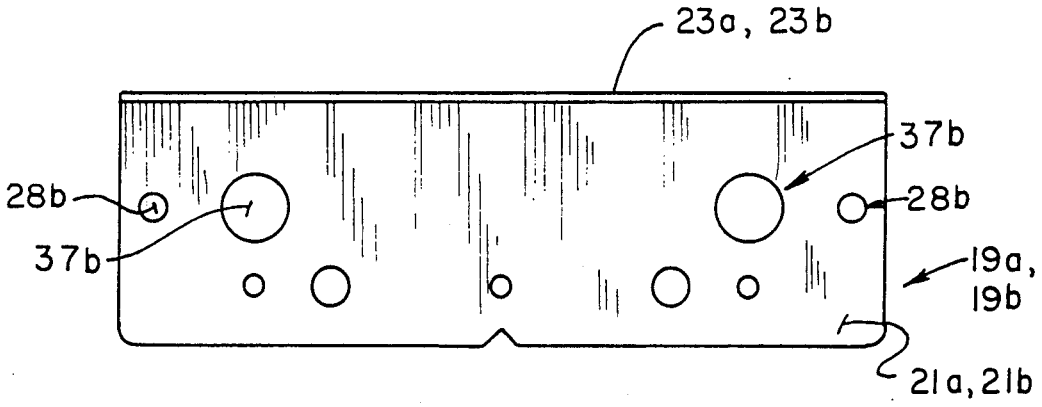
FIGS. 7–9 show the motor mounting bracket L-shaped member shown in FIG. 4.
Figure 8:
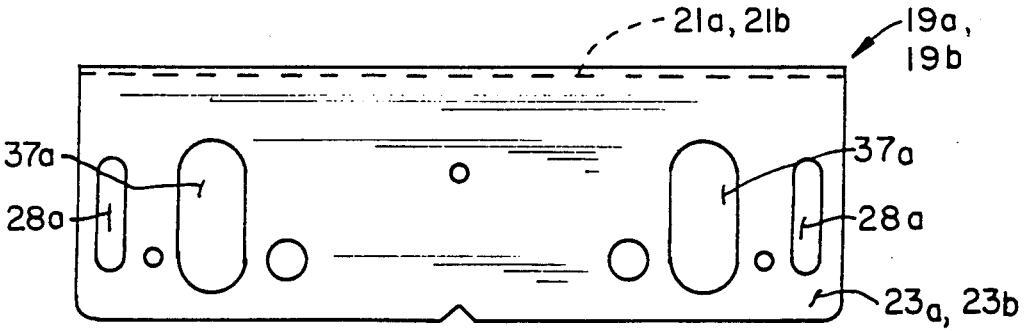
Figure 9:
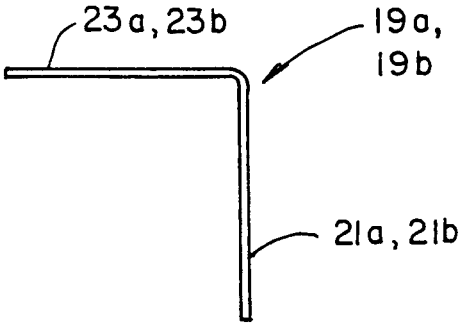

As shown in FIG. 4, motor bracket 9 comprises an identical pair of L-shaped brackets 19*a*, 19*b*. Each L-shaped bracket has a flanges 21*a*, 21*b* and 23*a*, 23*b*. As shown in FIG. 7, each flange 21*a*, 21*b* of each bracket 19*a*, 19*b* has circular apertures 28*b* and 37*b* therein. While, as shown in FIG. 8, flanges 23*a*, 23*b* of each bracket have elongate slots 28*a*, 37*a* therein. Elongated slots 28*a* and 37*a* allow for adjustment of the motor 3 on bracket 9 and for adjustment of bracket 9 on joist MJ.

Figure 2:
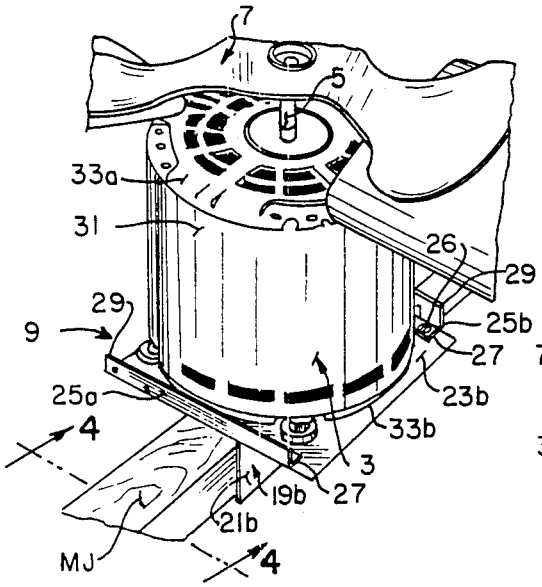
FIG. 2 is an enlarged perspective view of the fan motor as it is mounted on a single joist spanning an opening in the ceiling.

Downwardly extending flanges 21*a*, 21*b* of L-shaped brackets 19*a*, 19*b* are secured to opposite sides of joist MJ in the center of opening O by screws 22 or the like. Outwardly extending horizontal flanges 23*a*, 23*b* of brackets 19*a*, 19*b* have stiffeners 25*a*, 25*b* (see FIG. 2) on either side thereof. Stiffeners 25*a*, 25*b* extend from one flange 23*a* across joist MJ to the other flange 23*b*. Stiffeners 25*a*, 25*b* each include a horizontal flange 27 which is secured to flanges 23*a*, 23*b* by screws 26 through apertures 28*a* in the flanges 23*a* and 23*b*, and upwardly extending flanges 29 which stiffen motor mount bracket 9. The use of a pair of L-shaped brackets instead of a single U-shaped bracket allows for motor mount bracket 9 to accommodate joists of different widths by means of apertures 28*a* and 37*a* in flange 23*a*.

Motor 3 has a shell or housing 31 with end plates 33*a*, 33*b* on opposite sides thereof. Throughbolt 35 extend through housing 31 and protrude beyond bottom end plate 33*b*. Apertures 37*a* in flanges 23*a* and 23*b* receive elastomeric grommets 39 which receive throughbolt 35 to secure motor 3 to motor mount bracket 9. Elastomeric grommets 39 (see FIG. 4) surrounding throughbolt 35 are interposed between motor 3 and bracket 9 to reduce the effects of motor vibration. More specifically, grommets 39 vibrationally isolate motor 3 from bracket 9 and joist MJ and thus the vibrations, and undue noise, will not be transmitted into the motor joist. Motor 3 is secured to angle brackets 19*a*, 19*b* by suitable washers 41 and nuts 38 threaded on throughbolt 35.

Figure 3:
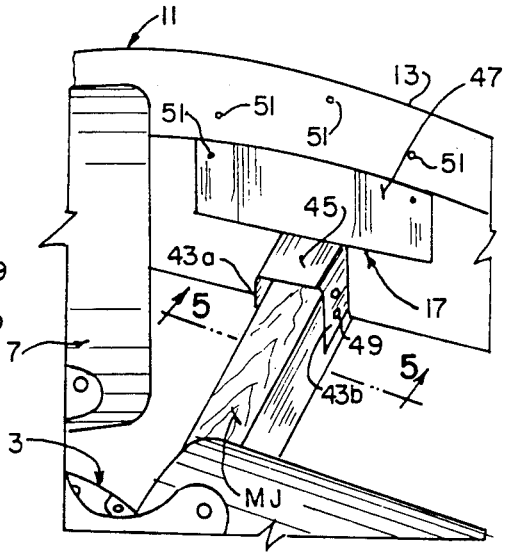
FIG. 3 is an enlarged perspective view illustrating a portion of the fan and a venturi bracket mounted on the motor joist for locating and securing the venturi.
Figure 5:
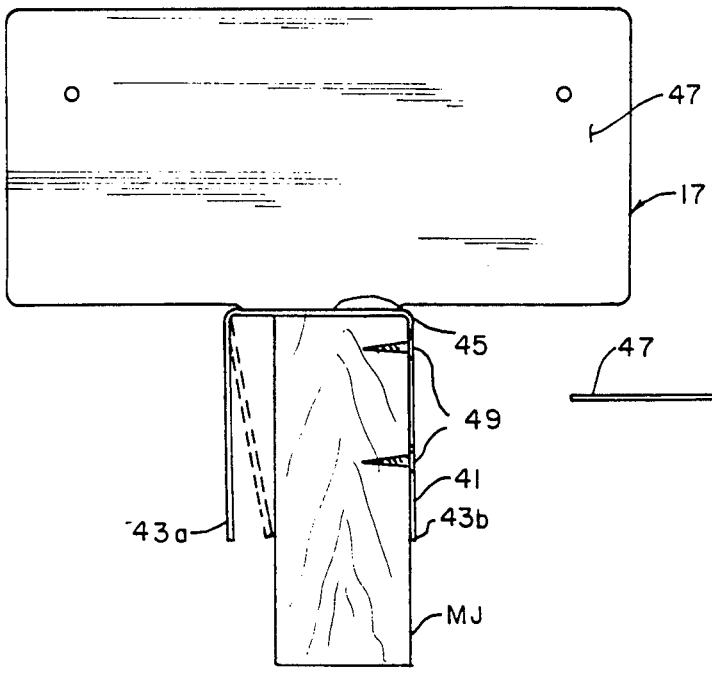
FIG. 5 is a cross sectional view taken along line 5—5 of FIG. 3 on an enlarged scale showing a venturi bracket secured to a joist.
Figure 6:
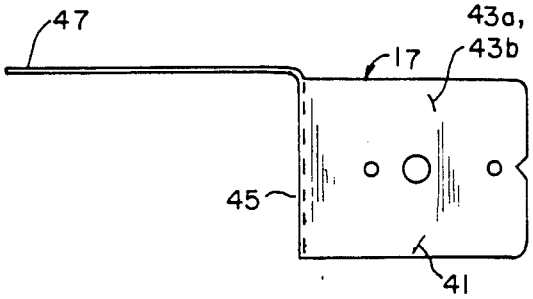
FIG. 6 is a right side elevational view of the venturi bracket rotated 90° counterclockwise from its position shown in FIG. 5.

As shown in FIGS. 5 and 6, venturi bracket 17 comprises a U-shaped sheet metal channel 41 having side legs 43*a*, 43*b* and a top plate 45. A venturi plate 47 extends up from top plate 45 and engages the inside face of venturi 13. Channel 41 is secured to one side of joist MJ by screws 49 driven through leg 43*a* or 43*b* into the joist. The unsecured leg is preferably bent inward against the joist MJ, as shown by dotted lines in FIG. 5. Venturi 13 is secured to venturi plate 47 by screws 51 (see FIG. 3).

Venturi skirt 15 (see FIG. 1) is formed of two sets of two identical pieces of corrugated board. The four pieces are held together at corners by means of tape as at 53. Three sets of pre-scored tabs 55 are provided on two opposing sides of skirt 15 to create openings 57 in the skirt to accommodate joists J and MJ, as shown in FIG. 1 The skirt is secured to venturi 13 by means of tape at the junction of the skirt and the fan housing, as at 59.

To install the fan assembly 1, the installer must first cut a hole O in the ceiling C. At least one joist must span the center of opening O. The joists are not cut. The installer then passes the venturi 13 up between the joists, positions it over the joists, centers it with respect to the opening O, and secures it to one side of the center joist MJ with venturi brackets 17. Joist L-shaped brackets 19*a*, 19*b* of motor bracket 9 are assembled to stiffeners 25*a*, 25*b* by screws 27. Grommets 39 are installed in L-shaped brackets 19*a*, 19*b* in flanges 23*a*, 21*b*. Washers 41 are placed on motor throughbolt 35. Motor through bolts 35 are then put through grommets 39. Another washer 41 is then placed on motor throughbolt 35 and motor 3 is secured to motor bracket 9 by means of nuts 38. The motor 3 and bracket 9 are centered with respect to venturi 13 on joist MJ and secured in place by screws 22. Fan blade 7 is installed on motor 3. The installer then secures the skirt to venturi 13, making sure it properly accommodates (i.e., surrounds) the joists J and MJ. A shutter assembly 61 (see FIG. 1) is then secured to the ceiling beneath the opening to cover the opening. Shutter assembly 61 has hinged shutters which open only when the fan is operating. Such a shutter assembly is well known in the art.

The components, especially the brackets, of this invention are smaller than the components of prior art whole house fans. A comparison of motor brackets 9 and the elongate, U-shaped brackets of certain other "easy to install" whole house fans, as shown in U.S. Pat. No. 4,385,550, shows that bracket 9 is considerably smaller. The smaller components allow for easier installation of whole house fan 1 from beneath opening O and for more compact packing and shipping of the fan.

The foregoing disclosure set forth for illustrative purposes only. Various changes could be made in the disclosed structure and method without departing from the scope of the invention.

What is claimed is:

1. In a whole house fan assembly for installation over joists in an opening in a ceiling, one of said joists spanning the center of said opening, the fan assembly defining an air path through said assembly; a venturi including a throat in said air path, a fan impeller for moving air through said air path, a fan motor for driving said fan, and a skirt depending from said venturi defining a portion of said air path, the improvement comprising: means for mounting said motor to only said one joist spanning said opening separate from said venturi.

2. The improvement of claim 1 wherein said one joist is substantially of rectangular cross section having a pair of opposed horizontal faces, and wherein said fan motor mounting means comprises a motor bracket having a pair of angles, each angle having a flange adapted to be secured to a respective vertical face of said one joist thereby to accommodate joists of different widths.

3. The improvement of claim 2 wherein each of said angles has an outwardly extending flange proximate the upper face of said joist to which said angles are secured, said motor bracket further comprising a pair of stiffening members mounted to said outwardly extending flanges for stiffening said motor bracket.

4. The improvement of claim 3 wherein said fan motor is secured to said motor bracket by bolts received in apertures in said angle flanges, with elastomeric grommets received on said bolts between said motor and said motor bracket to dampen motor vibrations.

5. The improvement of claim 1 wherein said improvement further includes at least one venturi bracket for mounting said venturi to said joist to which said motor is mounted, said venturi bracket comprising a U-shaped bracket adopted to fit over said joist, and an upwardly extending plate to which said venturi is attached.

6. A method of installing a whole house ceiling fan assembly on joists over an opening in a ceiling, the method of comprising the steps of:

cutting an opening in the ceiling such that the opening exposes at least one joist, said one joist spanning said opening and being substantially centered with respect to said opening;

securing a venturi to said one joist by means of at least one venturi bracket;

securing a motor to a motor bracket;

mounting said motor and motor bracket assembly on said one joist and substantially centering said motor with respect to said opening;

securing the said motor and bracket to only said one joist; and mounting a fan impeller on said motor such that said fan impeller is substantially centered with respect to said venturi.

7. The method of claim 6 further comprising attaching a skirt to said venturi so that said skirt depends downwardly therefrom, the skirt being pre-scored to define openings which cooperate with said joists in the ceiling.

8. The method of claim 6 further comprising a step of vibrationally isolating the motor from said one joist.

* * * * *